US007433615B2

(12) United States Patent
Murakami et al.

(10) Patent No.: US 7,433,615 B2
(45) Date of Patent: Oct. 7, 2008

(54) METHOD OF AND IMAGE FORMING APPARATUS FOR CONTROLLING A LIGHT EXPOSURE CONDITION

(75) Inventors: Wakako Murakami, Tokyo (JP); Nobuo Kuwahara, Yokohama (JP); Atsushi Sampe, Yokohama (JP); Yoshiyuki Kimura, Tokyo (JP); Hiroyuki Nagashima, Yokohama (JP); Hiroshi Hosokawa, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 308 days.

(21) Appl. No.: 11/281,378

(22) Filed: Nov. 18, 2005

(65) Prior Publication Data

US 2006/0120741 A1 Jun. 8, 2006

(30) Foreign Application Priority Data

Nov. 19, 2004 (JP) ..... 2004-336709

(51) Int. Cl.
*G03G 15/00* (2006.01)

(52) U.S. Cl. ..... 399/49; 399/51

(58) Field of Classification Search ..... 399/49, 399/51

See application file for complete search history.

(56) References Cited

U.S. PATENT DOCUMENTS 5,072,258 A * 12/1991 Harada ..... 399/50
5,307,118 A 4/1994 Morita
5,555,076 A 9/1996 Yoshiyama
6,014,530 A 1/2000 Tsunemi
2002/0141770 A1* 10/2002 Shimura ..... 399/49
2008/0069580 A1 9/2007 Oshige et al.
2007/0248368 A1 10/2007 Kato et al.

FOREIGN PATENT DOCUMENTS

JP 11-194557 7/1999
JP 2002-244368 8/2002
JP 2003-215859 7/2003

OTHER PUBLICATIONS

Patent Abstracts of Japan, JP 2004-077508, Mar. 11, 2004.

* cited by examiner

*Primary Examiner*—David M. Gray
*Assistant Examiner*—Ryan D Walsh
(74) *Attorney, Agent, or Firm*—Oblon, Spivak, McClelland, Maier & Neustadt, P.C.

(57) ABSTRACT

An image forming apparatus, incorporating a process cartridge, capable of determining optimum light exposure conditions suitable for both a charging potential and a film thickness of image bearing member, and performing the image formation even during the period from initiating to completing the setting of light exposure conditions. The image forming apparatus includes at least a charger unit, a light exposure unit, a developer unit, a detection unit, and a control unit. The detection unit is adapted to detect the total of rotation of the image bearing member. The control unit computes light exposure conditions to operate the light exposure unit based on an estimated thickness for a film of the image bearing member, which is calculated from the total of rotation obtained by the detection unit, and a first target uniform charging potential to control a uniform charging potential of the image bearing member, and to control the light exposure unit to be brought into the light exposure conditions.

18 Claims, 7 Drawing Sheets

METHOD OF AND IMAGE FORMING APPARATUS FOR CONTROLLING A LIGHT EXPOSURE CONDITION

This application claims priority to Japanese Patent Application No. 2004-336709, filed with the Japanese Patent Office on Nov. 19, 2004, the entire contents of which are hereby incorporated by reference.

FIELD OF INVENTION

The invention generally relates to electrophotographic image forming apparatuses, and more specifically to an image forming apparatus capable of determining optimum light exposure conditions suitable for both charging potential and the film thickness of an image bearing member, and performing the image formation even over the period of setting the light exposure conditions.

BACKGROUND OF INVENTION

The electrophotographic image forming process is well known. In image forming apparatuses such as a copying machine, a printer and a facsimile apparatus, the formation of the images is generally carried out through the electrophotographic process of forming electrostatic latent images on a photoreceptor. The photoreceptor is provided in its circumference with several image forming units such as a charging unit, a transfer roller, a developer unit, a cleaning blade, a cleaning brush and others.

Since the photoreceptor is generally brought into contact with these units, the surface of the photoreceptor (i.e., image bearing member) is worn away gradually with the rotation of the photoreceptor.

As a result, the thickness of a charge transport layer (which is the major part of the photoreceptor surface) gradually decreases and fluctuations in light exposure sensitivity may take place. It is considered that photo-induced discharge characteristics change with the abovementioned fluctuations and this causes further fluctuations in halftone image density. The photo-induced discharge characteristics are defined in the range from a uniform charging potential Vd down to a post-exposure potential V1, as will be detailed later on.

A measure for obviating the difficulty in the halftone image density may be contemplated. For example, the optimum amount of light exposure (or, optimum light exposure amount) L is determined for the thickness "t" of an image bearing member by (1) forming reference patterns of latent images on the surface of a photoreceptor at a predetermined timing under the conditions of both a uniform charging potential Vd and a developing bias Vb constant, and decreasing or increasing the amount of light exposure (or, light exposure amount) L by bits, (2) measuring the potential of the reference patterns with a potential sensor, and (3) based on the results from the potential measurement, adjusting the light exposure amount L such that a post-exposure potential V1 is brought close to a target post-exposure potential.

In this case, however, a drawback may be encountered, in which, since several latent image patterns have to be formed on the photoreceptor surface, another image formation can not be carried out over the period from initiating the formation of the latent image patterns to completing the determination of the optimum light exposure amount L for the film thickness t.

Japanese Laid-Open Patent Application No. 2002-244368 (application '368) describes a method, in which the thickness t of an image bearing member is estimated from a total of rotation and operating hours of, and number of copies made by, a photoreceptor. Thereafter, several parameters pertinent to suitable toner image density for the photoreceptor, such as a light exposure amount, a developing bias, and a charging bias are determined corresponding to the thickness t obtained as above.

Specifically, the optimum light exposure amounts L for the thicknesses, t1 through t5, for example, are computed in advance based on photo-induced discharge characteristics corresponding to the respective thicknesses, t1 through t5, and stored in a data storage unit in image forming apparatus as reference light exposure amounts corresponding to the respective thicknesses. The thickness t of an image bearing member is then estimated by a CPU in the apparatus from a total of rotation and operating hours of, and number of copies made by, a photoreceptor.

If the thickness t2 is obtained as the value of thickness by the CPU, one of the reference light exposure amounts corresponding to the t2 thickness is readout from the data storage unit, and thus readout amount is assigned to the optimum light exposure amount.

By adopting the method, which is described in the application '368, of reading out the optimum light exposure amount upon reaching a predetermined thickness for the photoreceptor in place of the aforementioned method of forming reference patterns of latent images, the optimum light exposure amount can now be determined suitable to an arbitrary thickness without forming the reference patterns.

Therefore, the aforementioned difficulty, in which another image cannot be formed over the period from initiating reference pattern formation to completing optimum light exposure determination for the thickness t, is considered to be obviated to a certain extent.

However, several problems are yet to be solved in the method of the application '368.

Namely, a plurality of discrete thickness values are stored in the data storage unit and the change in light exposure amount is made when the thickness of the image bearing member reaches one of the thickness values as described above. That is, no change in light exposure is feasible during the change from t1 to t2, for example. As a result, the problem of undue fluctuations in halftone toner density on the photoreceptor still exists over the period of the change.

In order to obviate the above noted difficulties, a method is contemplated in the present invention, in which a means is incorporated into the image forming apparatus to be capable of computing optimum light exposure amounts suitable to respective film thicknesses in place of the aforementioned method of storing optimum exposure values suitable to respective film thicknesses.

Then, the optimum light exposure amount can be computed by the present method to be suitable to the thickness estimated at a predetermined timing. Accordingly, it is considered that the difficulty mentioned above concerning no change of light exposure amount during the change from t1 to t2 can be obviated by the present method.

It may be noted that the technology is well known previously to improve image qualities over time and alleviate the effects from the environmental change, which is achieved by forming reference patterns of toner images on the surface of the photoreceptor, measuring the amount of toner adhered to the surface, and changing the developing bias Vb and uniform charging potential Vd based on the results obtained from the measurement.

Even in the case when the method of the application '368 is adopted and the optimum light exposure amount corresponding to the thickness is obtained after changing the uniform charging potential Vd, fluctuations may take place in toner image density on the photoreceptor.

This difficulty is considered due to the fact that photo-induced discharge characteristics of the photoreceptor may change with uniform charging potential Vd.

Namely, since the light exposure amount is obtained in this case based on the photo-induced discharge characteristics of the image bearing member corresponding to the film thickness without taking the effects of the above-noted change in the uniform charging potential into consideration, it is considered that the above difficulty is caused concerning the fluctuations in toner image density on the photoreceptor.

SUMMARY OF THE INVENTION

Accordingly, it is an object of this invention to provide an apparatus and method with improved capabilities of determining optimum light exposure conditions suitable for electrophotographic image formation having most, if not all, of the advantages and features of similarly employed apparatuses and methods, while reducing or eliminating many of the aforementioned disadvantages.

It is another object to provide an image forming apparatus, incorporating a process cartridge, capable of determining optimum light exposure conditions suitable for both a charging potential and a film thickness of image bearing member, and performing the image formation even over the period of setting the light exposure conditions.

The above and other object of the invention are achieved by providing an image forming apparatus, comprising a charger unit configured to charge the surface of an image bearing member, a light exposure unit configured to form an electrostatic latent image on the surface of the image bearing member, a developer unit configured to develop the electrostatic latent image into a toner image, a detection unit configured to detect the total of rotation of the image bearing member, and a first control unit configured to perform a computation of at least one light exposure condition to operate the light exposure unit based on an expected thickness for a film of the image bearing member calculated from the total number of rotation of the image bearing member and a first target uniform charging potential to control a uniform charging potential of the image bearing member, and control the light exposure unit to be in the at least one light exposure condition.

In addition, the image forming apparatus further includes an image density control unit configured to form at least one reference toner pattern on the image bearing member and detect a first image density of the at least one reference toner pattern;

a target potential decision table configured to store a first target developing bias for bringing a second image density to a target image density in reference to a second target uniform charging potential; and a second control unit configured to determine a second target developing bias based on the result from a detection of the first image density, determine the second target uniform charging potential based on the first target developing bias in reference to the target potential decision table, control the charging unit to be at the second target uniform charging potential, and control the developer unit to be at the second target developing bias.

In the image forming apparatus, the computation of the at least one light exposure condition is performed subsequent to determining the second target uniform charging potential and the second target developing bias by the second control unit based on the second target uniform charging potential and the total number of rotation of the image bearing member.

Still in addition, the image forming apparatus further includes an alteration unit configured to alter either at least one characteristic, or at least one light exposure sensitivity characteristic of the image bearing member, in which the computation of the at least one light exposure condition is performed based on the at least one light exposure sensitivity characteristic of the image bearing member obtained in advance in the course of designing in addition to a third target uniform charging potential to control a charging potential of the image bearing member, and the expected thickness of the image bearing member, and which the computation of the expected thickness of the image bearing member is performed based on the at least one characteristic of the image bearing member in addition to the total number of rotation of the image bearing member.

In the computation performed in the image forming apparatus, the at least one light exposure condition may be taken to be either an exposure time or an exposure light power.

In another aspect of the invention the image forming apparatus incorporates a process cartridge removably to a main chassis thereof, in which the process cartridge includes integrally at least one of the image bearing member, the charger unit, and the developer unit.

A method for forming an image for the image forming apparatus is also disclosed, including at least the steps of detecting the total number of rotation of the image bearing member, performing the computation of at least one light exposure condition to operate the light exposure unit based on the expected thickness for a film of the image bearing member calculated from the total number of rotation of the image bearing member and a first target uniform charging potential to control a uniform charging potential of the image bearing member, and controlling the light exposure unit to be in the at least one light exposure condition.

A more complete description of this method and other pertinent features of the image forming apparatus is provided later on in the section entitled "Description of the Preferred Embodiments."

These and other features and advantages of the invention will be more clearly seen from the following detailed description of the invention which is provided in connection with the accompanying drawings.

DETAILED DESCRIPTION OF PREFERRED EMBODIMENTS

Figure 1:
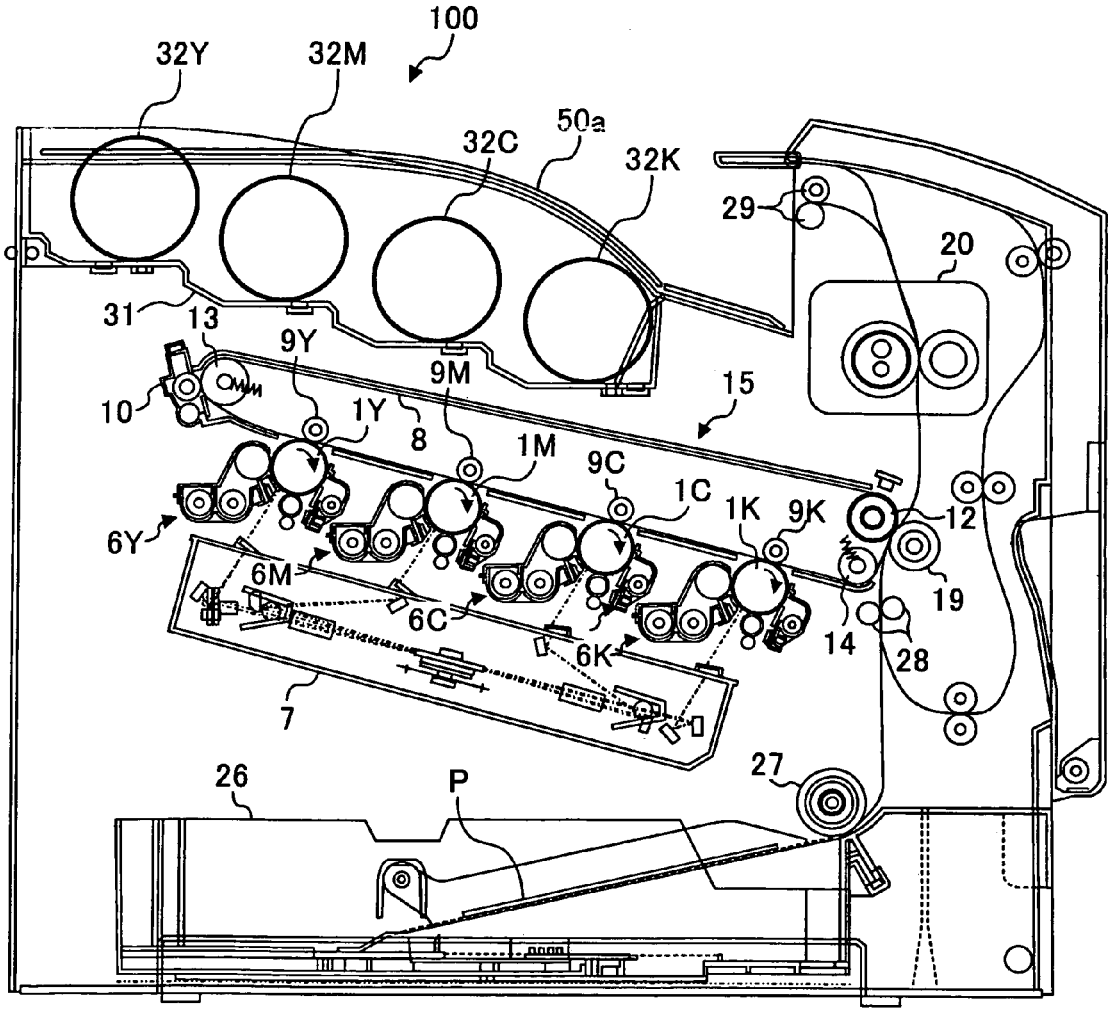
FIG. 1 is a drawing diagrammatically illustrating the overall view of a printer as the image forming apparatus of the invention.

In the detailed description which follows, specific embodiments of as the image forming apparatus and a method for forming an image for the image forming apparatus are described.

It is understood, however, that the present disclosure is not limited to these embodiments. For example, it is appreciated that the image forming apparatus and the method described may also be adaptable to any form of imaging systems. Other embodiments will be apparent to those skilled in the art upon reading the following description.

According to a general example in the present disclosure, an image forming apparatus includes at least a charger unit, a light exposure unit, a developer unit, a detection unit, and a first control unit.

The charger unit electrically charges the surface of an image bearing member, the light exposure unit forms an electrostatic latent image on the surface of the image bearing member, the developer unit develops the electrostatic latent image into a toner image, the detection unit detects the total of rotation of the image bearing member, and the first control unit is adapted to perform the computation of at least one light exposure condition to operate the light exposure unit based on the expected thickness for a film of the image bearing member calculated from the total number of rotation of the image bearing member and a first target uniform charging potential to control a uniform charging potential of the image bearing member, and to control the light exposure unit to be in the at least one light exposure condition.

In addition, the image forming apparatus further includes an image density control unit, a target potential decision table, and a second control unit.

The image density control unit forms at least one reference toner pattern on the image bearing member and detects a first image density of the at least one reference toner pattern.

The target potential decision table is adapted to store a first target developing bias for bringing a second image density to a target image density in reference to a second target uniform charging potential.

The second control unit determines a second target developing bias based on the result from a detection of the first image density, determines the second target uniform charging potential based on the first target developing bias in reference to the target potential decision table, controls the charging unit to be at the second target uniform charging potential, and controls the developer unit to be at the second target developing bias.

In the image forming apparatus, the computation of the afore-noted at least one light exposure condition is performed subsequent to determining the second target uniform charging potential and the second target developing bias by the second control unit based on the second target uniform charging potential and the total number of rotation of the image bearing member.

Still in addition, the image forming apparatus further includes an alteration unit.

The alteration unit is adapted to alter either at least one characteristic, or at least one light exposure sensitivity characteristic of the image bearing member, in which the computation of the at least one light exposure condition is performed based on the at least one light exposure sensitivity characteristic of the image bearing member obtained in advance in the course of designing in addition to a third target uniform charging potential to control a charging potential of the image bearing member, and the expected thickness of the image bearing member, and which the computation of the expected thickness of the image bearing member is performed based on the at least one characteristic of the image bearing member in addition to the total number of rotation of the image bearing member.

In the computation performed in the image forming apparatus, the afore-noted at least one light exposure condition may be taken to be either an exposure time or an exposure light power.

In another aspect of the invention the image forming apparatus incorporates a process cartridge removably to a main chassis of the apparatus, in which the process cartridge includes integrally at least one of the image bearing member, the charger unit, and the developer unit.

A method for forming an image for an image forming apparatus is also disclosed.

This method includes at least the steps of electrically charging the surface of an image bearing member, forming an electrostatic latent image on the surface of the image bearing member, developing the electrostatic latent image into a toner image, detecting the total number of rotation of the image bearing member, performing the computation of at least one light exposure condition to operate the light exposure unit based on the expected thickness for a film of the image bearing member calculated from the total number of rotation of the image bearing member and a first target uniform charging potential to control a uniform charging potential of the image bearing member, and controlling the light exposure unit to be in the at least one light exposure condition.

The method further includes the steps of forming at least one reference toner pattern on the image bearing member, detecting a first image density of the at least one reference toner pattern, storing a first target developing bias for bringing a second image density to a target image density in reference to a second target uniform charging potential to form a target potential decision table, determining a second target developing bias based on the result from the detection of the first image density, determining the second target uniform charging potential based on the first target developing bias in reference to the target potential decision table, controlling the charging unit to be at the second target uniform charging potential, and controlling the developer unit to be at the second target developing bias.

In the present method, the step of computing the at least one light exposure condition is performed subsequent to determining the second target uniform charging potential and the second target developing bias by the second control unit based on the second target uniform charging potential and the total number of rotation of the image bearing member.

In addition, the method further includes the step of altering either at least one characteristic, or at least one light exposure sensitivity characteristic of the image bearing member, in which the computation of the at least one light exposure condition is performed based on the at least one light exposure sensitivity characteristic of the image bearing member obtained in advance in the course of designing in addition to a third target uniform charging potential to control a charging potential of the image bearing member, and the expected thickness of the image bearing member, and which the computation of the expected thickness of the image bearing member is performed based on the at least one characteristic of the image bearing member in addition to the total number of rotation of the image bearing member.

The inventors have found through rigorous experimentation that photo-induced discharge characteristics of the image bearing member decreases in proportion to the increase in the uniform charging potential Vd of the member. This leads to the following expression between the uniform charging potential Vd and the amount of light exposure (or, light exposure amount) L, $L=\xi_1 Vd+\xi_2$.

Namely, since the photo-induced discharge characteristics of the image bearing member decreases linearly with increasing uniform charging potential Vd of the member, the post-exposure potential V1 can be brought to constant by increasing the light exposure amount L linearly with the increase in the uniform charging potential Vd of the image bearing member (or alternatively, by decreasing the light exposure amount L linearly with the decrease in Vd). As a result, a constant toner image density is obtained on the photoreceptor, which will be detailed later on.

In the invention, the light exposure amount L is first computed to correspond to presently set uniform charging potential Vd by above noted expression. Based on light exposure amount L thus computed, the optimum light exposure amount L corresponding to the present film thickness is computed.

Therefore, the optimum light exposure amount can suitably be determined after duly considering the change in the photo-induced discharge characteristics with both the uniform charging potential and the film thickness of the photosensitive member.

As described herein above, the image forming apparatus according to the invention is formed to be capable of determining optimum light exposure conditions by estimating the thickness of an image bearing member from the total of rotation of a photoreceptor and calculating the conditions based on the calculated thickness and a target uniform charging potential. The optimum light exposure conditions can be determined suitable for both charging potential and the film thickness of an image bearing member.

As a result, excellent image densities can be retained even after the decrease in film thickness and the change of uniform charging potential.

In addition, since the optimum light exposure amount can be determined without forming reference patterns on the photoreceptor, the image formation can be feasible even over the period from initiating to completing the setting light exposure conditions.

Having described the present disclosure in general, an exemplary embodiment of image forming apparatus will be described herein below according to the present invention. This image forming apparatus is a printer of the electrophotographic type and hereinafter referred to as "printer."

In the first place, an overall construction of the printer is described.

FIG. 1 is a drawing diagrammatically illustrating the overall view of a printer 100.

Referring to FIG. 1, the printer 100 includes at least four process cartridges, 6Y, 6M, 6C, and 6K, for forming Y (yellow), M (magenta), C (cyan), and K (black) toner images, respectively. While Y, M, C, and K toner particles of respective different colors are supplied into respective process cartridges as image forming materials, the construction thereof is substantially the same otherwise. They are each formed to be replaceable on expiring operating life.

Figure 2:
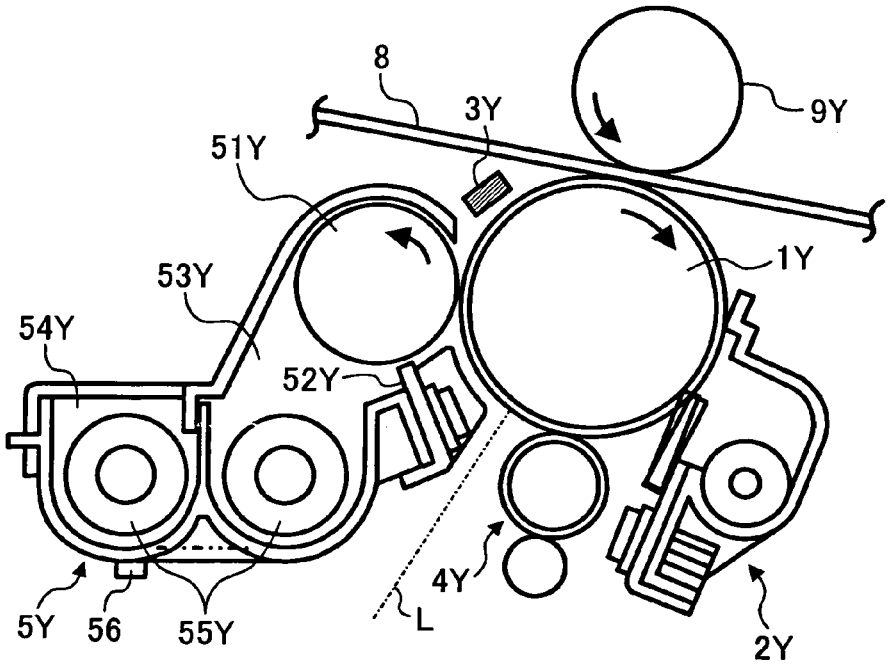
FIG. 2 is a cross sectional view primarily illustrating a process cartridge for forming Y toner images.

In reference to FIG. 2, for example, the process cartridge 6Y for forming Y toner image includes a drum-shaped photoreceptor member 1Y, a drum cleaning unit 2Y, a discharger unit (not shown), a charger unit 4Y, a developer unit 5Y, and a toner concentration sensor 3Y.

The process cartridge 6Y as an image forming unit is designed to be removable from the system unit of the printer 100 and its expendable supply portions to be replaceable altogether at one time.

The charger unit 4Y is adapted to uniformly charge the surface of the photoreceptor member 1Y while rotating clockwise on the drawing by a driving means (not shown).

The uniformly charged surface of the photoreceptor member 1Y is exposed to irradiation with a laser light beam L, which is scanned corresponding to the image data. Electrostatic latent images for forming Y image (Y latent images) are now generated on the photoreceptor 1Y.

The Y latent images are then developed by the developer unit 5Y to form Y toner images using a Y developing agent consisting of magnetic carrier granules and Y toner colorant particles. Subsequently, the Y toner images are subjected to intermediate transfer onto an intermediate transfer belt 8.

The surface of the photoreceptor 1Y on completing the intermediate transfer is cleaned by removing residual toners by the drum cleaning unit 2Y, and residual charges are dissipated by the discharging unit (not shown). The surface of the photoreceptor 1Y is initialized through this discharging step to be ready for a next imaging cycle.

In a similar manner, M, C, and K toner images are formed respectively on the 1M, 1C, and 1K photoreceptors, and transferred onto the intermediate transfer belt 8.

The developer unit 5Y is provided with a developing roller 51Y, which is positioned to be partially exposed through an opening of a developer casing. In addition, the developer unit 5Y is also provided with two transporting screws 55Y, 55Y, which are positioned in parallel with one another, a doctor blade 52Y, and a toner concentration sensor (or T sensor) 56Y.

As described earlier, the developer unit 5Y contains the Y developing agent consisting of magnetic carrier granules and Y toner colorant particles. Being transported while stirred by two transporting screws 55Y, 55Y, the Y developing agent is triboelectrically charged and subsequently disposed onto the surface of the developing roller 51.

Thereafter, the Y developing agent is controlled in its layer thickness on the development roller 51 by the doctor blade 52Y, brought to a development region corresponding to the photoreceptor 1Y, and adheres to the Y latent images previously formed on the photoreceptor 1Y. As a result of the adherence of developing agent, Y toner images are formed on the photoreceptor 1Y.

After consuming at least some Y toner portion during image development in developer unit 5Y, the Y developing agent is brought back to the casing by the rotating development roller 51.

A partition strip (or wall) is provided between two transporting screws 55Y, 55Y so that the portion of the casing is divided by the wall into two, one a first supply unit 53Y at the right on the drawing (FIG. 2) and the other a second supply unit 54Y at the left. The first supply unit 53Y includes the development roller 51 and the transporting screws 55Y on the right, and the second supply unit 54Y includes the transporting screw 55Y on the left.

Through a rotatory drive by a driving means (not shown), the transporting screw 55Y on the right is adapted to transport the Y developing agent in the first supply unit 53Y backward on the drawing and then into the development roller 51Y.

The Y developing agent, which is transported close to the bottom edge of the first supply unit 53Y by the right transporting screw 55Y, is directed to proceed to the second supply unit 54Y on the left through an opening (not shown) provided on the partition wall.

In the second supply unit 54Y, by contrast, the transporting screw 55Y on the left is rotated by another driving means (not shown) to transport the Y developing agent, which is previously forwarded from the first supply unit 53Y, in the forward direction on the drawing (i.e., in the direction opposite to that in the supply unit 53Y).

The Y developing agent, which is now transported close to the frontal edge of the second supply unit 54Y by the left transporting screw 55Y, is directed to return to the first supply unit 53Y through another opening.

The T sensor 56Y is provided with a magnetic permeability sensor to be placed approximately in the middle of bottom wall of the second supply unit 54Y. The T sensor 56Y is configured to output voltages according to magnetic permeability of Y developing agent detected by the sensor during the transport.

For the two-component developer composition consisting of toner particles and magnetic carrier granules, the magnetic permeability is known to be correlative to the concentration of the toner to a certain extent. The T sensor 56Y is therefore operative of outputting voltages in proportion to Y toner concentration.

The figures of the output voltages are then sent to a control unit (not shown). The control unit in turn is provided with RAM as a memory unit which is configured to store several data as target figures of output voltages, Vtref, for the Y toner.

Also stored in the RAM are other target figures of voltages, Vtref, corresponding to the values from other T sensors (not shown) related to M, C, and K toners, which are respectively included in the M, C, and K developer units.

In addition, the Vtref values for the Y toner are used for suitably controlling the drive of Y toner transport unit which will be detailed later on.

Specifically, by bringing the voltage output from T sensor 56Y as close as possible to Vtref target figures for Y toner, the control unit is configured to control the driving of the Y toner transport unit (not shown) so as to supply Y toner particles properly into the second supply unit 54Y.

Through such control steps as mentioned above for supplying toner particles, it becomes feasible for the Y toner concentration in the developer unit 5Y be maintained within a predetermined range.

In a similar manner, these steps for controlling the toner concentration are also carried out by M, C, and K toner transport units included in M, C, and K developing units, respectively.

A photo-sensor (or P sensor) 3Y is further included in the developer unit 5Y (FIG. 2) as a means for detecting the amount of adhered toner. The P sensor 3Y includes a light emitting element for irradiating light onto photoreceptor drum and a photodetector element for receiving light reflected by the photoreceptor.

The P sensor 3Y is adapted to change its output voltage according to the intensity of light reflected by toner images formed on the photoreceptor 1Y. The intensity of the reflected light changes with a parameter, $\gamma$, which corresponds to the amount of toner adhered to the toner image per unit area. Therefore, the P sensor 3Y is operative of changing output voltages according to the $\gamma$ value. The output voltages are sent to the control unit as digital signals by way of an A/D converter (not shown), for example.

An exposure unit 7 is further provided below the process cartridges, 6Y, 6M, 6C and 6K, as also shown in FIG. 1.

The exposure unit 7 as a means for forming latent images is configured to illuminate a laser beam L while scanning onto the photoreceptor units, 3Y, 3M, 3C and 3Bk. The beam L is emanated after modulated corresponding to respective color images and serves to expose respective photoreceptors included in 3Y, 3M, 3C and 3Bk photoreceptor units. By means of the laser beam exposure, Y, M, C and K latent images are formed on 1Y, 1M, 1C and 1K photoreceptors, respectively.

Although details are abbreviated herein, the exposure unit 7 assumes a conventional configuration, in which a laser beam L emanated from a light source is scanned while deflected by a rotating polygonal mirror driven a motor, lead through several optical elements such as, for example, lenses and mirrors, and irradiates upon incident on the photoreceptors.

Therefore, the exposure unit 7 constitutes a toner image formation means in conjunction with the 6Y, 6M, 6C and 6K process cartridges and others.

A sheet feeding means is provided under the exposure unit 7, including a copy sheet cassette 26, a sheet feeding roller 27, and a registration roll pair 28.

The copy sheet cassette 26 is adapted to load thereon plural transfer paper sheets P as recording medium materials stacked as a batch with an uppermost sheet thereof being pressed against the sheet feeding roller 27.

When the feeding roller 27 is driven to rotate counterclockwise on the drawing, the uppermost transfer sheet P is fed forward to the registration roll pair 28.

The registration roll pair 28 rotates to nip the forwarded transfer sheet and halts its rotation once subsequent to nipping. The roll pair 28 then operates to feed the nipped transfer sheet P forward to a secondary transfer nip in proper timing, which will be described later on.

Therefore, the sheet feeding roller 27 constitutes a recording material feeding means in combination with the roll pair 28 as a timing roll pair. The recording material feeding means is therefore adapted to transport a copy sheet P from the sheet cassettes 26 to the secondary transfer nip.

An intermediate transfer unit 15 is provided above the 6Y, 6M, 6C and 6K process cartridges, including an intermediate transfer belt 8 as an intermediate transfer member, which is suspended, tension wound, and subjected to endless rotation.

The intermediate transfer unit 15 is further provided with a cleaning unit 10, four primary transfer biasing rollers, 9Y, 9M, 9C, and 9K, a secondary transfer backup roller 12, a cleaning backup roller 13, and a tension roller 14.

The intermediate transfer belt 8 is suspended and tension wound around the abovementioned seven rollers, subjected to endless and counterclockwise rotation which is caused by a rotatory drive by at least one these rollers.

These four primary transfer biasing rollers, 9Y, 9M, 9C, and 9K, are arranged such that primary transfer nips are formed between 1Y, 1M, 1C, and 1K photoreceptors, respectively, provided with the intermediate transfer belt 8 intervening therebetween, which is subjected to endless and counterclockwise rotation, as mentioned above.

The reverse side (i.e., internal circumference) of the intermediate transfer belt 8 is designed to have a transfer bias applied thereto of the polarity opposite to that of the toner (e.g., positive). The rollers other than biasing rollers, 9Y, 9M, 9C, and 9K, are all electrically grounded.

With the passage by the endless rotation of the intermediate transfer belt 8 sequentially through the Y, M, C, and K primary transfer nips, toner images in Y, M, C, and K color are subjected to primary transfer sequentially overlapped. As a result, quadruple-color toner images are formed, which are hereinafter referred to as quad-color toner images.

The secondary transfer backup roller 12 is arranged to form a secondary transfer nip between the secondary transfer belt 19, provided with the intermediate transfer belt 8 intervening therebetween.

The quad-color toner images, which are previously formed as visual images on the intermediate transfer belt 8, are transferred to a transfer sheet P at the secondary transfer nip. Thus, full color toner images arise in combination with white color of transfer sheet.

Some of toner particles are left unused on the surface of secondary transfer belt 19 following the passage through the secondary nip. These residual toner particles are subsequently cleaned by the cleaning unit 10.

A fixing unit 20 is provided with a heated roller and a pressing roller, which are brought into contact with one another to form a fixing nip.

The transfer sheet P sent out from the secondary nip is forwarded to the fixing nip, where the full color toner images are permanently fixed onto the surface of transfer sheet P by suitably heating under pressure.

Thereafter, the paper sheet P is discharged by way of sheet discharging roll pair 29 to the exterior of the apparatus.

A stacker unit 50*a* is provided on the upper face of the main chassis of the printer to receive by sequentially stacking up the paper sheets P discharged from the internal image forming path.

In addition, a bottle holding unit 31 is provided between the intermediate transfer unit 15 and the stacker unit 50*a* (FIG. 1). This unit 31 serves to hold toner bottles, 32Y, 32M, 32C, and 32K, which contains Y, M, C, and K toner particles, respectively. The 32Y, 32M, 32C, and 32K toner bottles are arranged such that the elevation thereof changes gradually descending from 32Y bottle down to 32K bottle as illustrated in FIG. 1.

The Y, M, C, and K toner particles in the 32Y, 32M, 32C, and 32K toner bottles are properly supplied to developer units included in process cartridges 6Y, 6M, 6C, and 6K, respectively.

Moreover, these 32Y, 32M, 32C, and 32K toner bottles are provided here to be removable from the main chassis of the printer 100 independently of respective process cartridges 6Y, 6M, 6C, and 6K.

Figure 3:
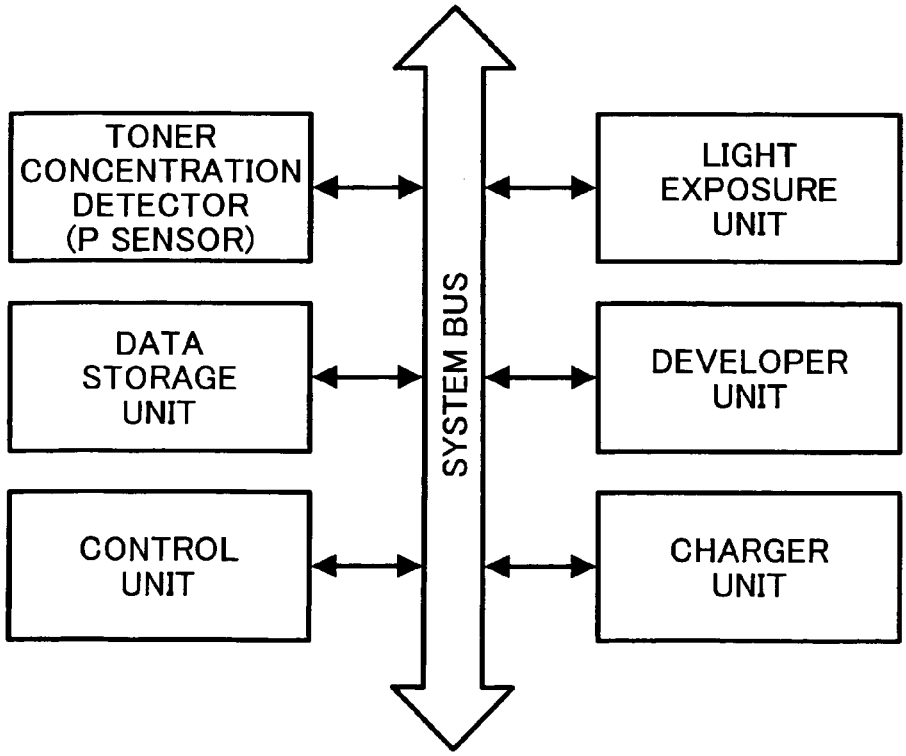
FIG. 3 is a block diagram illustrating the principal configuration for controlling the printer as the image forming apparatus of the invention.

FIG. 3 is a block diagram illustrating the principal configuration for controlling the printer as the image forming apparatus of the invention.

Referring to FIG. 3, the configuration includes a system bus, a control unit, a means for detecting the amount of adhered toner, a developer unit, a charger unit, an exposure unit, and a data storage unit.

The control unit is configured to perform several control measures such as determining whether the concentration of toner on a photoreceptor, which is lately detected by the toner amount detection means, coincide with its target value; computing a proper amount of light exposure L based on the target uniform charging potential and the number of photoreceptor rotation; controlling the developer unit to be applied by a target developing bias; controlling the exposure unit to attain a target light exposure amount; controlling the charging bias such that a uniform charging potential Vd of a photoreceptor is brought to coincide with its target uniform charging potential; and serving as a means for changing parameters used for computing proper light exposure amounts.

The data storage unit is configured to store several coefficients and figures such as the film scraping coefficient $\omega$ for computing a light exposure amount L; coefficients, $\xi_1$ and $\xi_2$, for adjusting a LD power; the coefficient $\tau$ for conversion of light exposure value on imaging surface over time; an accumulated (or, total) number of photoreceptor rotation; and an initial thickness of photoreceptor film.

Also stored in the data storage unit are a target decision table and a charging bias decision table.

Since the magnitude of toner charging in the image forming apparatus of the invention is suitably maintained by triboelectrical-charging between the toner particles and carrier granules, this magnitude may be affected considerably by environmental conditions.

Upon changing the magnitude of toner charging, image development characteristics also change. Therefore, desired image quality may not be acquired as a result of the change.

In specific terms, the amount of toner adhered to latent image portions increases with decreasing the magnitude of toner charging, whereby image density increases. By contrast, the toner amount on latent image portions decreases with increasing the magnitude, whereby image density tends decrease.

Therefore, several measurements of the amount of toner adhered to the photoreceptor are performed in the present embodiment to overcome the above-noted difficulty. Based on the result obtained from the measurements, both a uniform charging potential Vd on the photoreceptor and a developing bias Vb are properly adjusted accordingly.

In the first place, a description will be given on the measurement of the amount of toner adhered to the surface of 1Y, 1M, 1C, and 1K photoreceptors.

In the present embodiment, a process control action (which is hereinafter referred to as "pro-con action") for properly adjusting image density for each color is carried out every time when the machine power is turned on or a predetermined number of sheets are printed.

In the course of the pro-con action, several patches (which are hereinafter referred to as "reference patterns") for use in detecting toner concentration are formed on the photoreceptors. Namely, the reference patterns on each of 1Y, 1M, 1C, and 1K photoreceptors are formed under the conditions of the light exposure amount L constant and both the uniform charging voltage Vd and the developing bias Vb decreased by bits.

The developing potential is defined by the difference between the electrostatic latent image potential and the developing bias. Since the reference patterns are formed with decreasing developing biases as described above, the pattern formed afterward is under the condition of higher developing potential. This results in higher image density for the later reference pattern.

For each of thus formed reference patterns, the image density is measured by P sensors 3Y, 3M, 3C, and 3K (FIG. 2) included in the process cartridges 6Y, 6M, 6C, and 6K, respectively.

Although it is illustrated in the present embodiment for the image density of reference patterns to be measured on the photoreceptors by P sensors 3Y, 3M, 3C, and 3K, the measurement may alternatively be carried out after intermediate transfer of the reference patterns onto the intermediate transfer belt 8.

In this case, the P sensors are placed at the location opposing to the intermediate transfer belt 8. Specifically, the P sensor may be placed at the location opposing to the tension roller 14 (FIG. 1). Also, in this case, it is necessary for the reference patterns of respective colors to be transferred without mutual overlap on the intermediate transfer belt 8.

Figure 4:
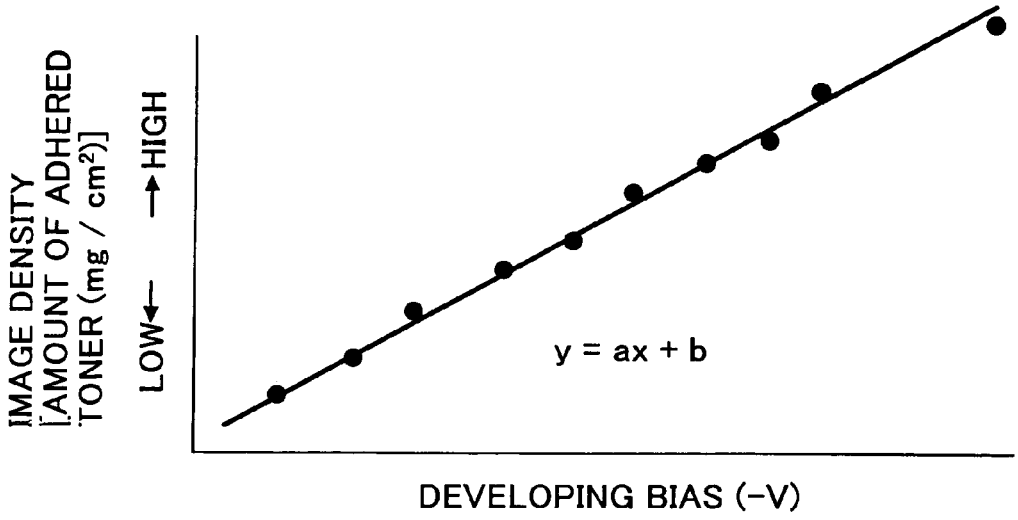
FIG. 4 is a graphical illustration of the relation between the developing bias for forming reference patterns and the image density of the reference patterns.

The relation between the developing bias for forming reference patterns and the image density of the patterns is graphically illustrated in FIG. 4. Namely, there found herein is a positive correlation between the developing bias and image density (i.e., the amount of toner adhered to the toner image per unit area), which is shown as a graph of a straight line in FIG. 4. Therefore, the value of bias voltage corresponding to desired image density is computed according to the linear relationship, y=ax+b.

A regression analysis is carried out by the control unit for respective colors using the values of developing bias and toner image density data of the reference patterns, and coefficients for the function (regression equation) are obtained experimentally corresponding to the straight-line graph shown in FIG. 4. Thereafter, proper developing biases are computed by substituting target values of image density into the equation, whereby target developing biases are obtained for respective Y, M, C, and K colors.

On the other hand, a target decision table is provided in the data storage unit, in which the developing biases Vb are each stored in reference to uniform charging potential Vd appropriate to the biases Vb.

Referring to the target decision table, the control unit selects a developing bias Vb, which is the closest to the target developing potential, and is able to identify a target uniform charging potential Vd corresponding to the developing bias Vb.

The uniform charging potential Vd on the photoreceptor changes with the charging bias.

A charging bias decision table is provided in the data storage unit, in which charging biases are each stored in reference to target uniform charging potentials Vd.

If a uniform charging potential Vd is selected, the charging bias decision table is read out and the charging bias corresponding to thus selected uniform charging potential Vd is identified referring the table. Subsequently, the surface of photoreceptor is brought to the target uniform charging potential Vd.

Even after careful consideration of the uniform charging potential Vd and developing bias Vb, resultant image density may differ from the desired density by possible fluctuations in halftone density.

Figure 5:
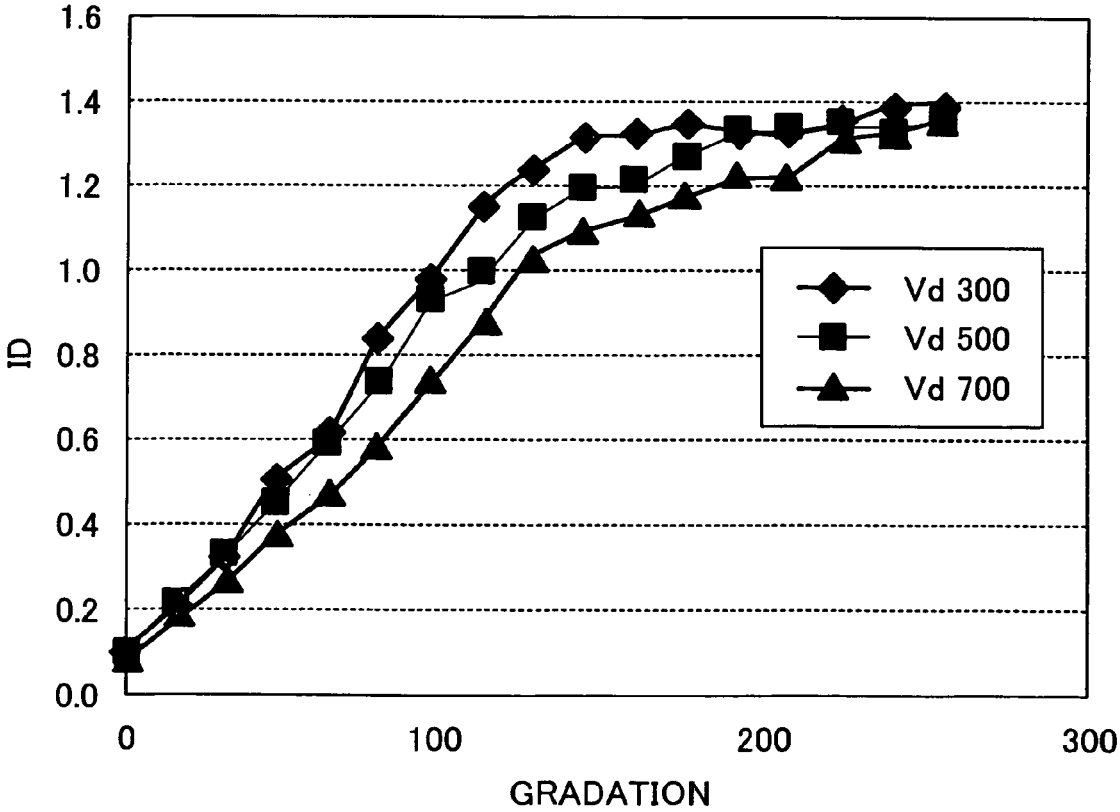
FIG. 5 shows several plots illustrating the results of image density versus gradation, which are obtained at different target charging potentials Vd under a constant amount of light exposure.

FIG. 5 shows several plots illustrating the results of image density (ID) versus gradation, which are obtained at different target charging potentials Vd under a constant amount of light exposure L, whereby the abovementioned fluctuations in halftone density are shown.

The reason for the fluctuations is considered due to the fact that light sensitivity of photoreceptor changes with the change of uniform charging potential Vd, and that photo-induced discharge characteristics, which are represented by detailed discharge pattern from the uniform charging potential Vd down to post-exposure potential V1, also change.

In more concrete terms, the reason is given in more detail herein below.

Figure 6:
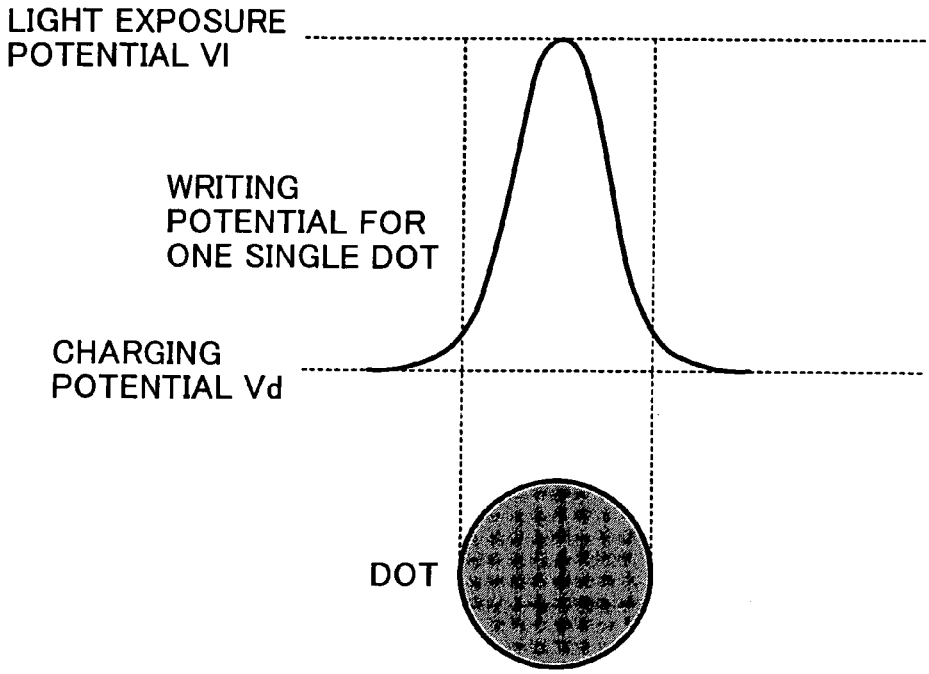
FIG. 6 is a drawing illustrating the distribution of latent image potential after light beam writing of one single dot on a photoreceptor.

FIG. 6 is a drawing illustrating the distribution of latent image potential after light beam writing of one single dot on a photoreceptor.

The latent image characteristics of the photoreceptor are generally described in terms of the uniform charging potential Vd and post-exposure potential V1. However, when the distribution of latent image potential after light beam writing of one single dot is closely examined, intermediate potentials are recognized depending on the location within the dot as shown in FIG. 6.

The shape of the intermediate potential may be different depending on the value of uniform charging potential Vd even for the same maximum value of post-exposure potential V1.

It should be noted, since the correction mentioned earlier is carried out based on the amount of adhered toner, γ, this amount obtained in solid image portions can be obtained with relative consistency corresponding to the maximum post-exposure potential V1.

By contrast, no specific consideration has been made on intermediate potentials related to halftone densities. The change in post-exposure potential V1 is therefore caused by the change of the uniform charging potential Vd.

As a result, the developing potential, that is, the difference between the uniform charging potential and post-exposure potential (or, Vd−V1) changes at the halftone region, whereby the fluctuations in the halftone image densities take place.

Therefore, in the case when a target charging potential Vd is changed, it is necessary to provide suitable corrections of halftone image density to be brought to proper toner concentration by changing light exposure amount L.

In the present embodiment, the corrections of halftone densities are provided as follows; when target uniform charging potential Vd is varied, a desirable amount of light exposure L is computed in reference to the target uniform charging potential Vd so that the halftone image densities are brought to proper densities.

The amount of light exposure L is related to the uniform charging potential Vd by the following expression.

$$L=\xi_1 Vd+\xi_2 \quad (1).$$

The coefficients, $\xi_1$ and $\xi_2$, in the expression (1) are used for correcting LD power, which are obtained in advance in the course of designing from experiment using the photoreceptor and exposure unit.

Figure 7:
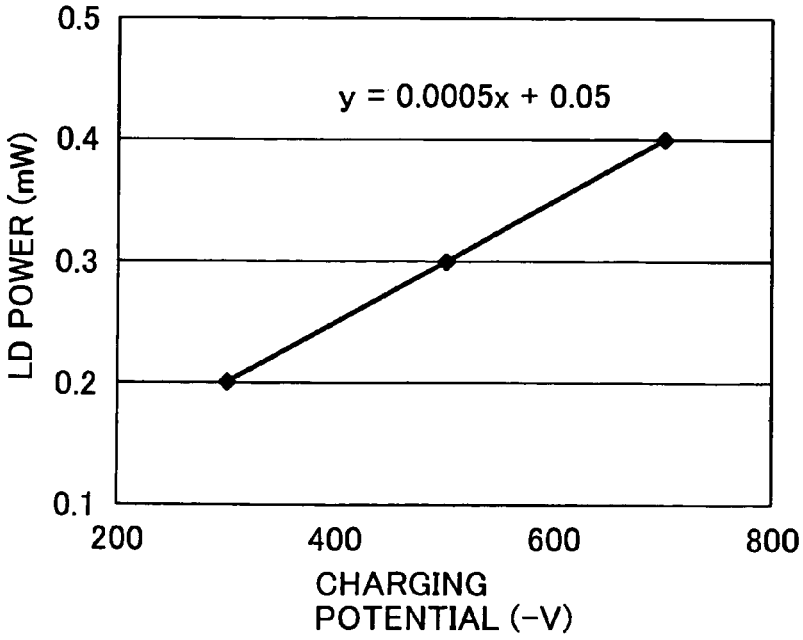
FIG. 7 illustrates graphically the relation obtained from the experiment between the amount of light exposure L and uniform charging potential Vd.

FIG. 7 illustrates graphically the relation obtained from the experiment between the amount of light exposure L (LD power) and uniform charging potential Vd.

The above-noted experiment is carried out by charging the surface of a photoreceptor by a charger unit, exposing the surface with changing the amount of light exposure L, forming patterns of electrostatic latent images, and measuring post-exposure potential V1 and uniform charging potential Vd of each pattern by a potential sensor.

Thereafter, the term ΔV (i.e., Vd−V1) is calculated using the V1 and Vd results measured by potential sensor during the experiment. In addition, upon reaching a predetermined value of the computed ΔV/Vd term, the L and Vd values corresponding thereto are plotted, whereby a graphical relationship is obtained as illustrated in FIG. 7.

The $\xi_1$ and $\xi_2$ coefficients for correcting LD power in the expression (1) are calculated from the plot. In the present example shown in FIG. 7, the coefficients, $\xi_1$ and $\xi_2$, are obtained to be 0.005 and 0.05, respectively.

These coefficients, $\xi_1$ and $\xi_2$, are stored in the data storage unit. The pro-con action is now performed utilizing the coefficients, in which the control unit operates to readout the coefficients from the data storage unit and computes a proper amount of light exposure L.

Figure 8:
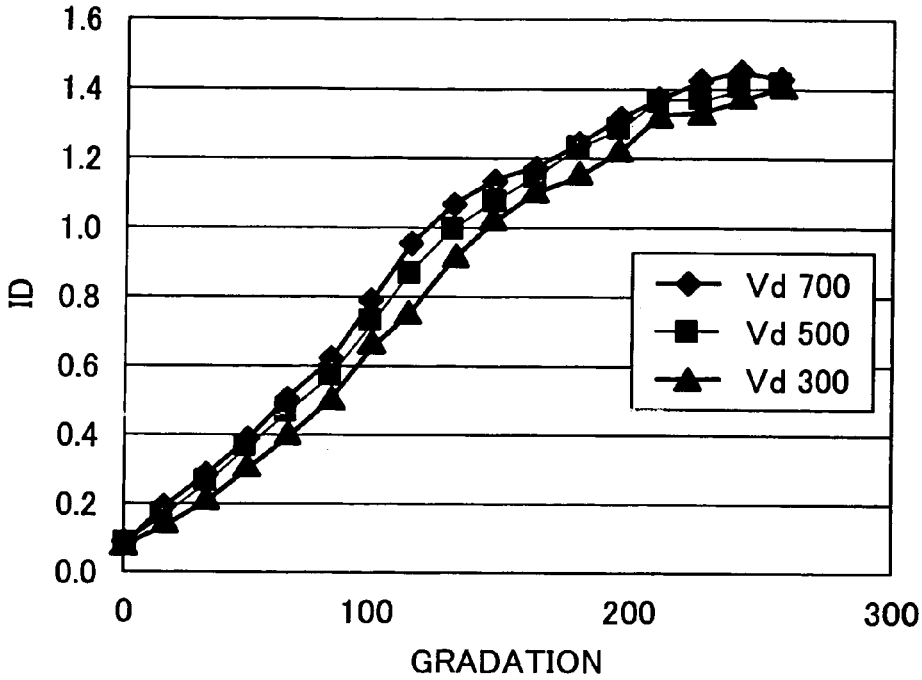
FIG. 8 shows several plots illustrating the results of image density versus gradation.

FIG. 8 shows several plots illustrating the results of image density (ID) versus gradation, where the L values calculated by the equation (1) are taken to assume L values corresponding to varied uniform charging potentials Vd.

It is shown in FIG. 8 that the halftone image density can remain constant even after changing the uniform charging potential by bringing the light exposure amount L to the corrected L value which is calculated to conform to the uniform charging potentials after the change.

Therefore, when the magnitude of toner charging changes, the toner concentration can be brought to the target concentration by suitably changing the developing bias Vb, uniform charging potential Vd, and light exposure amount L.

However, even after correcting the amount of light exposure L according to the equation (1) as described above, the halftone image density may unduly decrease.

The reason for this decrease is considered due to the fact that the decrease in film thickness of the photosensitive member, which is caused by scraping off over repeated usage, affects to change photo-induced discharge characteristics of the photoreceptor. As a result, even the light exposure is carried out with corrected amount of light exposure L, post-exposure potential V1 may not be generated as expected.

Figure 9:
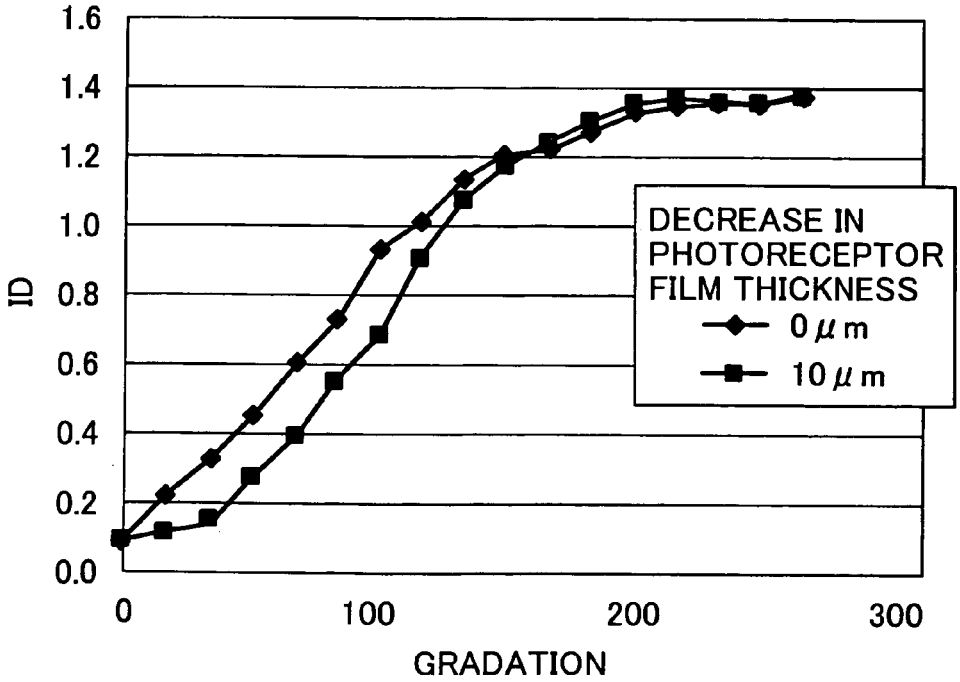
FIG. 9 shows several plots illustrating the results of image density versus gradation, which are obtained when the film thickness of photosensitive members decreases.

FIG. 9 shows several plots illustrating the results of image density versus gradation, which are obtained when the film thickness of photosensitive members decreases. It may be noted that other conditions such as light exposure amount L, developing bias Vb, and uniform charging potential Vd remain constant during the measurements.

From the results illustrated in FIG. 9, it is indicated that the decrease of image density in the halftone region is more evident for the photoreceptor having a film thickness of photosensitive member decreased by 10 mμ in comparison to the member without the film decrease.

This decrease of image density is considered due to the change of photo-induced discharge characteristics caused by the decrease in film thickness of the photosensitive member, including concomitant changes in detailed discharge pattern in the course of the decrease from the uniform charging potential Vd down to post-exposure potential V1.

Figure 10:
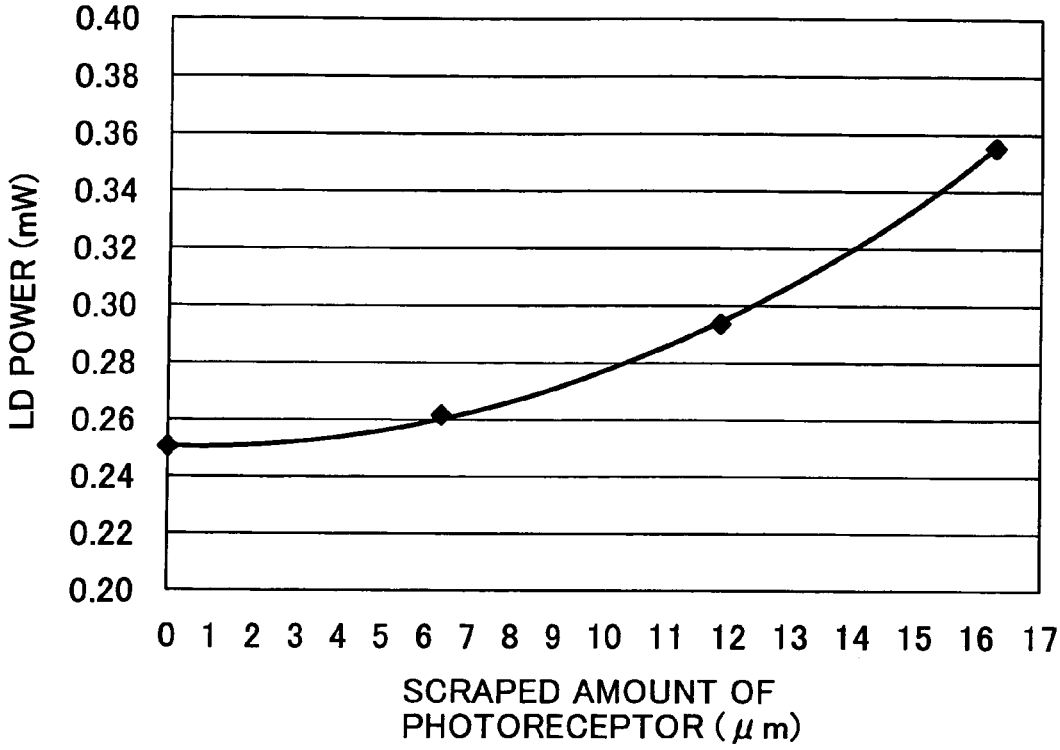
FIG. 10 is a graphical plot illustrating the relation between the amount of light exposure and the film thickness under the condition of constant ΔV/Vd.

FIG. 10 is a graphical plot illustrating the relation between the amount of light exposure L and the film thickness under the condition of constant ΔV/Vd. It is indicated by the plot of FIG. 10 that the amount of light exposure L for maintaining the constant ΔV/Vd increases with increasing the film wastage (i.e., the decrease in film thickness of photosensitive member).

Therefore, the amount of light exposure L is calculated in the present embodiment after more detailed consideration on the decrease in film thickness of photosensitive member. Specifically, by counting the total number of photoreceptor rotation, then calculating the decrease in the film thickness of photosensitive member, a proper value of the light exposure L is obtained based on thus calculated decrease in the film thickness.

The decrease in the film thickness of photosensitive member is obtained by the expression, $$d_0 - d_1 = \omega t \times 10^{-9} \quad (2),$$

where ω is the coefficient for scraping the photosensitive member film, $d_0$ the initial film thickness of the member, $d_1$ the film thickness over time, and t the total travel distance of photoreceptor rotation.

The parameters, such as the scraping coefficient ω and the initial film thickness $d_0$, are stored in the data storage unit. The total travel distance t is calculated from the total number of rotation and the diameter of the photoreceptor.

The number of rotation of the photoreceptor is counted by a reflex photosensor, for example.

Figure 11:
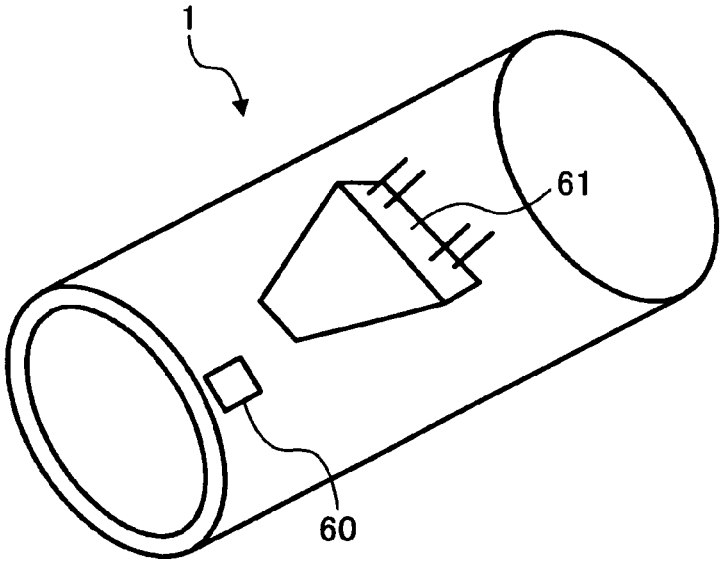
FIG. 11 is a perspective view diagrammatically illustrating the reflex photosensor used for counting the rotation of the photosensitive member.

FIG. 11 is a perspective view diagrammatically illustrating the reflex photosensor used for counting the rotation.

Referring to FIG. 11, a rotation sensing mark 60 is provided outside of image forming region on the photoreceptor 1. In addition, the reflex photosensor 61 is placed on the circumference of the photoreceptor 1 in a specified orientation at such a location as to sense the sensing mark 60 along the rotation of the photoreceptor.

The photosensor 61 detects the sensing mark 60 once every rotation and a detection signal is sent to the control unit. By counting the number of the detection signal, the control unit is able to count the number of rotation of the photoreceptor, and has the number stored in data storage unit in the control unit.

At the time of computing the aforementioned proper amount of light exposure L, the total travel distance t is calculated from the values stored in the data storage by multiplying the diameter of the photoreceptor by the total of rotation.

Although the reflex photosensor is used for detecting the photoreceptor as mentioned above, this is not intended limiting but another type of sensor such as, for example, a magnetic sensor may alternatively be used. In such a case, the rotation sensing mark 60 is formed of magnetic materials and a magnetic sensor is used in place of the abovementioned reflex photosensor.

In addition, another means may alternatively be utilized for obtaining the number of rotation, in that, after accumulating the number of the copy made, the resultant number may be taken as the total of rotation.

Since the scraping coefficient ω is a parameter which varies depending on the kind of the photoreceptor and the conditions of forming images such as the number of photoreceptor rotation and others, this coefficient ω is so adapted as to be changed when the photoreceptor is replaced.

For example, this change can be made for process cartridges, 6Y, 6M, 6C, and 6K, which are each integrally including photoreceptors, development units, and charger units, respectively, as mentioned earlier. On a frame of each process cartridge, an IC chip is provided to store therein its scraping coefficient ω.

The control unit is configured, upon displacing the photoreceptor, to establish the communication with the IC on the frame to thereby readout the scraping coefficient ω which is presently stored. Subsequently, the control unit rewrites the scraping coefficient ω to thus readout coefficient ω.

It will be noted that the means for rewriting the scraping coefficient ω is not limited to those described above but may be replaced with other suitable means such as, for example, changing the coefficient by way of the control panel included in the image forming apparatus.

After taking the decrease in film thickness into consideration for photosensitive member, and according to the aforementioned two relations, one the relation concerning the film thickness decrease of photosensitive member expressed by the expression (2), and the other between light exposure amount L and uniform charging potential Vd by the expression (1), a corrected amount of light exposure L' is expressed by the by the following expression.

$$L' = L\left(\frac{d_1}{d_0}\right)^{-\tau} = (\xi_1 V_d + \xi_2)\left(\frac{d_0 - \omega t \times 10^{-9}}{d_0}\right)^{-\tau}, \quad (3)$$

where the parameter $\tau$ is a coefficient of light exposure conversion over time (or, over time light exposure conversion coefficient), which is obtained in advance from the photoreceptor characteristics. In the present embodiment, the parameter $\tau$ is obtained as 0.7.

Thus, the decrease of image density in the halftone region, which is caused by the decrease in film thickness of the photosensitive member, can be corrected properly.

Although the uniform charging potential and the decrease of halftone image density caused by the decrease in film thickness are corrected as described above by suitably changing light exposure power (the amount of light used for writing by way of a laser optical system), the means used for the correction is not limited to those described above, but may be replaced with other means such as for suitably changing the period of time of writing (i.e., of light exposure).

This period of time for the light exposure may vary with PWM signals by suitably controlling on-time of a laser light source. Since the switch-on time per PWM cycle for a laser diode (i.e., exposure time) increases with increasing the duty cycle of PWM signal, the post-exposure potential V1 decreases for the photoreceptor.

In the case of controlling the decrease in halftone image density by changing the light exposure time, it is noted that the vertical axis of FIG. 7 is assigned to PWM duty (%) in place of the LD power in the previously description, and that the coefficients, $\xi_1$ and $\xi_2$, for correcting the LD power may be different from those previously obtained.

Namely, the experiment is carried out by exposing the surface of a photoreceptor with changing exposure time, forming patterns of electrostatic latent images, and measuring post-exposure potential V1 and uniform charging potential Vd of each pattern by a potential sensor.

Thereafter, in a manner similar to the experiment mentioned earlier in reference to FIG. 7, post-exposure potential V1 and uniform charging potential Vd are measured for each pattern. The term ΔV (i.e., Vd−V1) is then calculated for each various L and Vd values using the V1 and Vd results obtained from the measurements.

In addition, upon reaching a predetermined value of the computed ΔV/Vd term, the L and Vd values corresponding thereto are plotted. From the graphical plot thus obtained, the coefficients, $\xi_1'$ and $\xi_2'$, for the laser exposure time are calculated from the plot. In the present example using the same photoreceptor as that used earlier, the $\xi_1'$ and $\xi_2'$ coefficients for correcting the laser exposure time are obtained to be 0.08 and 15, respectively.

In the present embodiment, the steps for computing the light exposure L are adapted to be performed subsequent to the pro-con action.

Figure 12:
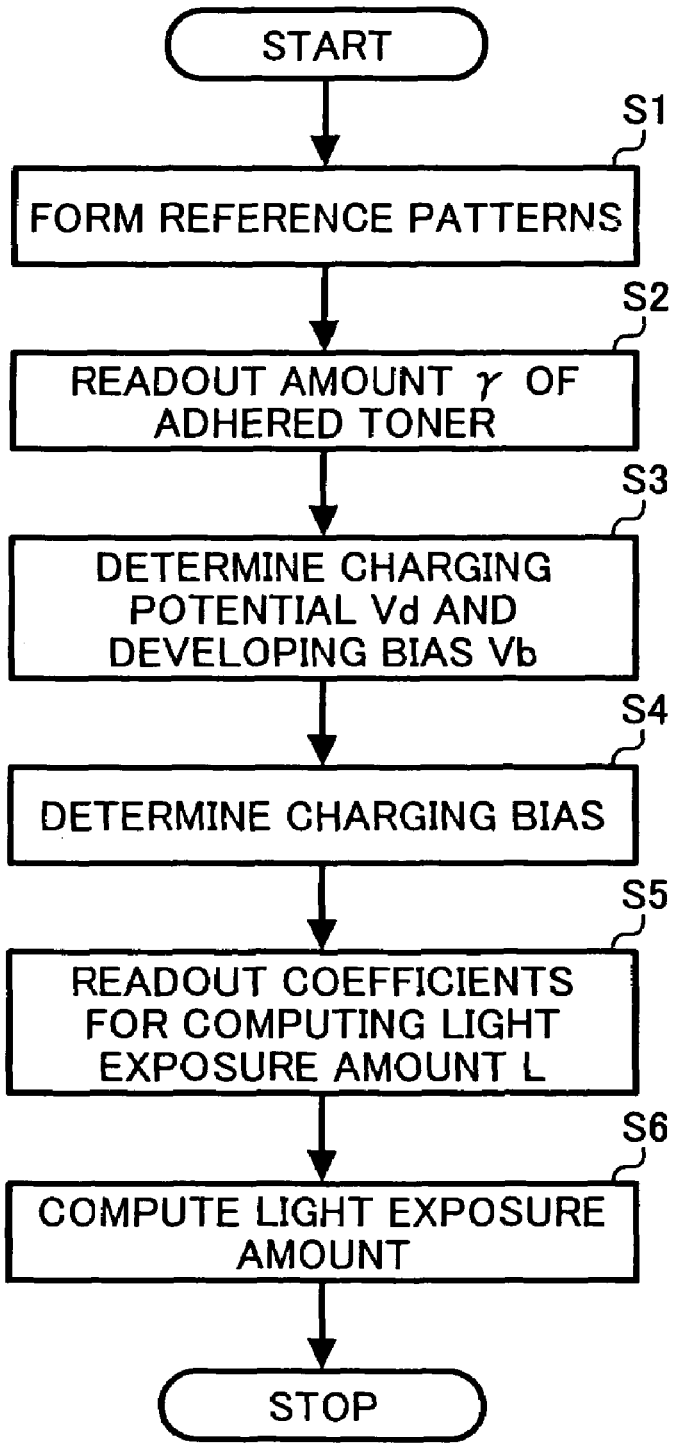
FIG. 12 is a flow chart illustrating process steps for computing the amount of light exposure L.

FIG. 12 is a flow chart illustrating process steps for computing the amount of light exposure L.

In the first place, reference patterns of electrostatic latent images are formed by exposing the surface with changing a developing bias and a charging bias (Step S1). The amount of toner adhered to a photoreceptor is read by a P sensor and analyzed by the control unit (S2).

Based on the results obtained from the analysis and referring to the target table, another target charging potential Vd and developing bias Vb are determined (S3).

In the second place, another charging bias is determined according to the target charging potential Vd (S4).

On determining the charging bias, the control unit reads out several figures and coefficients from the data storage unit, such as coefficients, $\xi_1$ and $\xi_2$, for correcting LD power, a film scraping coefficient $\omega$, an over time light exposure conversion coefficient $\tau$, a total number of photoreceptor rotation, an initial film thickness $d_0$, and a diameter of the photoreceptor (S5).

Subsequently, the control unit instructs to compute a renewed light exposure based on the target charging potential Vd and the figures and coefficients readout as above (S6).

Although the steps for computing the amount of light exposure L are described herein above to be performed subsequent to the pro-con action, the steps are not so limited.

For example, another amount of light exposure L may be calculated alternatively on reaching a predetermined value of total number of photoreceptor rotation. A next light exposure is then carried out with thus calculated amount of light exposure L.

It is apparent from the above description including the examples disclosed, that the image forming apparatuses disclosed herein has several advantages over similar apparatuses previously known.

For example, the image forming apparatus according to the invention is capable of determining optimum light exposure conditions by estimating the thickness of an image bearing member from the total of rotation of a photoreceptor and calculating the conditions based on the calculated thickness and a target uniform charging potential. The optimum light exposure conditions can therefore be determined suitable for both charging potential and the film thickness of an image bearing member.

As a result, excellent image densities can be retained even after the decrease in film thickness and the change of uniform charging potential.

In addition, since the optimum light exposure amount can be determined without forming reference patterns, the image formation can be feasible out even over the period from initiating to completing the setting light exposure conditions.

Also in the invention, reference patterns of toner images for detecting image density are formed on the surface of photoreceptor and measured by image density detecting means, a target developing potential is determined from the results obtained by the detecting means so that the maximum image density becomes constant, a uniform charging potential Vd on the photoreceptor surface is determined referring to the target potential decision table from the target developing potential, and the charging unit is controlled to be brought to the target uniform charging potential.

Since the target developing bias and the target charging potential are determined from the density of toner adhered onto the photoreceptor, the undue change in image density caused by fluctuations in the magnitude of toner charging can be alleviated.

It may be added that the reference patterns are formed under the conditions of both uniform charging potential and light exposure amount L constant and the developing bias varied by bits, since the patterns are formed to obtain target developing bias suitable for the present magnitude of toner charging.

By contrast, in order to determine optimum light exposure amount L suitable for film thickness, reference patterns have to be formed under the conditions of both developing bias and uniform charging potential constant and the light exposure amount L varied.

In addition, after determining a target uniform charging potential and a target developing bias from the amount of toner adhered to the photoreceptor, the light exposure conditions are determined based on thus determined target uniform charging potential Vd.

Since the target uniform charging potential Vd is utilized for the computation as a parameter capable of suppressing the change in the image density with the magnitude of toner charging, undue change can be obviated in image density caused by both the fluctuations in the magnitude of toner charging and the decrease in the film thickness.

Still in addition, the alteration unit in the image forming apparatus is provided to be capable of altering several figures and parameters, for use in computing light exposure conditions, such as photoreceptor characteristics, and light exposure sensitivity characteristics of photoreceptor.

As described earlier, the former characteristics are the film scraping coefficient $\omega$, the coefficient $\tau$ for conversion of light exposure value over time, and the initial film thickness $d_0$, while the latter characteristics are the coefficients, $\xi_1$ and $\xi_2$, for adjusting the LD power (or exposure time).

On providing a fresh photoreceptor in the image forming apparatus, therefore, the alteration unit instructs the storage unit to update its contents concerning the film scraping coefficient $\omega$, the coefficient $\tau$ for conversion of light exposure value over time, and the initial film thickness $d_0$. Subsequently, by reading out thus updated coefficients, $\omega$ and $\tau$, and the film thickness $d_0$, and computing the light exposure conditions, proper light exposure amount can be obtained suitable for the present film thickness.

As to the light exposure conditions for the image forming apparatus, an exposure light power is included. Therefore, by designing the light intensity of light emitting element be controlled to change continuously with the change of at least one of electric current and voltage, the amount of light exposure can be altered continuously.

Alternatively, an exposure time may be included in the light exposure conditions. By controlling the exposure time such as, for example, the turn-on period of light emitting element, the control over the light exposure amount can be achieved more easily than controlling the light intensity. In this case, therefore, the control of the light exposure becomes feasible with a higher accuracy.

In addition, the image forming apparatus in the invention incorporates a process cartridge removably to a main chassis of the apparatus. This process cartridge is formed integrally including at least one of the image bearing member, the charger unit, and the developer unit. As a result, replacement works of the photoreceptor, developer unit, and other similar units become feasible with more ease, and maintenance workability of these units improves substantially.

While the invention has been described in connection with the preferred embodiment, it will be understood that it is not intended to limit the invention to the embodiment. On the contrary, it is intended to cover such modifications or variations as may come within the scope of the following claims.

What is claimed is:

1. An image forming apparatus, comprising:

a charger unit configured to charge a surface of an image bearing member;

a light exposure unit configured to form an electrostatic latent image on the surface of said image bearing member according to a light exposure condition;

a developer unit configured to develop said electrostatic latent image into a toner image;

a detection unit configured to detect a total number of rotations of said image bearing member;

an image density control unit configured to form at least one reference toner pattern on the image bearing member, and detect an image density of said at least one reference toner pattern;

a target potential decision table configured to store a target developing bias for bringing an image density of a subsequent toner pattern to a target image density and to store a target uniform charging potential that corresponds to the target developing bias; and a control unit configured to compute an adjustment of the at least one light exposure condition for said light exposure unit based on a thickness of a film of said image bearing member calculated from the total number of rotations of said image bearing member and the target uniform charging potential of said image bearing member, and the control unit is configured to control said light exposure unit to form a subsequent electrostatic latent image according to the adjusted at least one light exposure condition.

2. The image forming apparatus according to claim 1, wherein the control unit is configured to control said charger unit to be at said target uniform charging potential, and control said developer unit to be at said target developing bias.

3. The image forming apparatus according to claim 2, further comprising:

an alteration unit configured to alter one of at least one characteristic, and at least one light exposure sensitivity characteristic of said image bearing member, wherein the computation of said at least one light exposure condition is performed based on said at least one light exposure sensitivity characteristic of said image bearing member obtained in advance in the course of designing, the target uniform charging potential, and an expected thickness of said image bearing member, and a computation of said expected thickness of said image bearing member is performed based on said at least one characteristic of said image bearing member and the total number of rotations of said image bearing member.

4. The image forming apparatus according to claim 3, wherein said at least one light exposure condition is exposure time.

5. The image forming apparatus according to claim 3, wherein said at least one light exposure condition is exposure light power.

6. The image forming apparatus according to claim 3, wherein said image forming apparatus incorporates a process cartridge removably to a main chassis thereof, and said process cartridge includes integrally at least one of said image bearing member, said charger unit, and said developer unit.

7. The image forming apparatus according to claim 1, further comprising:

an alteration unit configured to alter one of at least one characteristic, and at least one light exposure sensitivity characteristic of said image bearing member, wherein the computation of said at least one light exposure condition is performed based on said at least one light exposure sensitivity characteristic of said image bearing member obtained in advance in the course of designing, and the target uniform charging potential, and an expected thickness of said image bearing member, and a computation of said expected thickness of said image bearing member is performed based on said at least one characteristic of said image bearing member and the total number of rotations of said image bearing member.

8. The image forming apparatus according to claim 1, wherein said at least one light exposure condition is exposure time.

9. The image forming apparatus according to claim 1, wherein said at least one light exposure condition is exposure light power.

10. The image forming apparatus according to claim 1, wherein said image forming apparatus incorporates a process cartridge removably to a main chassis thereof, and said process cartridge includes integrally at least one of said image bearing member, said charger unit, and said developer unit.

11. A method for forming an image for an image forming apparatus, comprising:

forming at least one reference toner pattern on an image bearing member;

detecting an image density of the at least one reference toner pattern;

storing a target developing bias for bringing an image density of a subsequent toner pattern to a target image density and to store a target uniform charging potential that corresponds to the target developing bias;

charging a surface of the image bearing member;

forming an electrostatic latent image on the surface of said image bearing member according to at least one light exposure condition;

developing said electrostatic latent image into a toner image;

detecting a total number of rotations of said image bearing member;

computing an adjustment of the at least one light exposure condition to control the forming the electrostatic latent image based on an expected thickness for a film of said image bearing member calculated from the total number of rotations of said image bearing member and the target uniform charging potential of said image bearing member, and adjusting the at least one light exposure condition according to the computing the adjustment such that a subsequent toner image is formed according to the adjusted light exposure condition.

12. The method according to claim 11, further comprising the steps of:

controlling a charging unit to be at the target uniform charging potential; and controlling a developer unit to be at the target developing bias.

13. The method according to claim 12, further comprising:

altering one of at least one characteristic, and at least one light exposure sensitivity characteristic of said image bearing member, wherein the computing the adjustment of said at least one light exposure condition is performed based on said at least one light exposure sensitivity characteristic of said image bearing member obtained in advance in the course of designing, the target uniform charging potential, and an expected thickness of said image bearing member, and a computation of said expected thickness of said image bearing member is performed based on said at least one characteristic of said image bearing member in addition to the total number of rotations of said image bearing member.

14. The method according to claim 13, wherein said at least one light exposure condition is exposure time.

15. The method according to claim 13, wherein said at least one light exposure condition is exposure light power.

16. An image forming apparatus, comprising:

means for charging a surface of an image bearing member;

means for forming an electrostatic latent image on the surface of said image bearing member according to at least one light exposure condition;

means for developing said electrostatic latent image into a toner image;

means for detecting a total number of rotations of said image bearing member;

means for forming at least one reference toner pattern on said image bearing member and detecting an image density of said at least one reference toner pattern;

means for storing a target developing bias for bringing an image density of a subsequent toner pattern to a target image density and storing a target uniform charging potential that corresponds to the target developing bias; and computing an adjustment of the at least one light exposure condition to control said means for forming an electrostatic latent image based on an expected thickness for a film of said image bearing member calculated from the total number of rotations of said image bearing member and the target uniform charging potential of said image bearing member, and means for controlling said means for forming an electrostatic latent image to form a subsequent electrostatic latent image according to the adjusted at least one light exposure condition.

17. The image forming apparatus according to claim 16, further comprising:

means for controlling a charging unit to be at said target uniform charging potential, and means for controlling a developer unit to be at said target developing bias.

18. The image forming apparatus according to claim 17, further comprising:

means for altering one of at least one characteristic, and at least one light exposure sensitivity characteristic of said image bearing member, wherein a computation of said at least one light exposure condition is performed based on said at least one light exposure sensitivity characteristic of said image bearing member obtained in advance in the course of designing, the target uniform charging potential, and an expected thickness of said image bearing member, and a computation of said expected thickness of said image bearing member is performed based on said at least one characteristic of said image bearing member in addition to the total number of rotations of said image bearing member.

* * * * *